US010909958B2

(12) United States Patent
Hofuku

(10) Patent No.: US 10,909,958 B2
(45) Date of Patent: Feb. 2, 2021

(54) ELECTRONIC MUSICAL INTERFACE

(71) Applicant: CASIO COMPUTER CO., LTD., Tokyo (JP)

(72) Inventor: Hiroki Hofuku, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/584,269

(22) Filed: Sep. 26, 2019

(65) Prior Publication Data

US 2020/0111467 A1 Apr. 9, 2020

(30) Foreign Application Priority Data

Oct. 3, 2018 (JP) ..... 2018-188196

(51) Int. Cl.

*G10H 1/38* (2006.01)
*G10H 1/00* (2006.01)
*G10H 1/34* (2006.01)

(52) U.S. Cl.

CPC ..... *G10H 1/38* (2013.01); *G10H 1/0008* (2013.01); *G10H 1/344* (2013.01); *G10H 2210/005* (2013.01); *G10H 2210/066* (2013.01); *G10H 2220/091* (2013.01); *G10H 2220/221* (2013.01)

(58) Field of Classification Search

CPC ..... G10H 1/38; G10H 1/0008; G10H 1/344; G10H 2220/221; G10H 2220/091; G10H 2210/005; G10H 2210/066

See application file for complete search history.

(56) References Cited

U.S. PATENT DOCUMENTS 5,003,860 A * 4/1991 Minamitaka ..... G10H 1/28 84/609
6,143,971 A * 11/2000 Aoki ..... G10H 1/0025 84/609
6,245,984 B1 * 6/2001 Aoki ..... G10H 1/0025 84/611
6,323,411 B1 * 11/2001 Fukata ..... G09B 15/04 84/477 R (Continued)

FOREIGN PATENT DOCUMENTS

JP S63-106781 A 5/1988
JP H11-344972 A 12/1999

(Continued)

*Primary Examiner* — Jeffrey Donels
(74) *Attorney, Agent, or Firm* — Chen Yoshimura LLP

(57) ABSTRACT

An electronic musical interface performs the following: displaying a chord function progression of a first segment of a musical piece that is to be played by a user in a first region of a display via identifiers specifying respective chord functions; playing back an automatic accompaniment of the first segment; receiving user performance data as the user plays the musical note input device along with the playback of the automatic accompaniment; analyzing each chord contained in the obtained user performance data to determine the chord function of each chord the user played; and displaying, in a second region of the display alongside the first region, an identifier that identifies the determined chord function of the chord the user plays so that the user can determine whether the chord function of each chord the user played matches the chord function of the chord displayed in the first region.

17 Claims, 7 Drawing Sheets

(56) References Cited

U.S. PATENT DOCUMENTS

| | | | | |
|---|---|---|---|---|
| 2009/0064851 | A1* | 3/2009 | Morris | G10H 1/383 84/637 |
| 2010/0175540 | A1 | 7/2010 | Ikeya et al. | |
| 2016/0140944 | A1* | 5/2016 | Bergman | G06F 3/04886 84/613 |

FOREIGN PATENT DOCUMENTS

| | | | |
|---|---|---|---|
| JP | 2010-160396 | A | 7/2010 |
| JP | 2014-77965 | A | 5/2014 |
| JP | 2016-224462 | A | 12/2016 |

* cited by examiner

ELECTRONIC MUSICAL INTERFACE

TECHNICAL FIELD

The present invention relates to an electronic musical interface, a method to be performed by a computer to realize the electronic musical interface, an information display device realizing the electronic musical interface, and an electronic musical instrument equipped with the electronic musical interface.

BACKGROUND ART

In the field of electronic musical instruments, which have become more common in recent years, there are instruments in which music is stored in advance as data so as to make it possible for the stored music to be played by user (performer) operations or to allow the user to play along together with the music. In such instruments, it is common for information about the music currently being performed to be displayed on a display unit included in the electronic musical instrument or on a separately prepared display device. Here, the information provided to the user during the performance includes information such as pitch and rhythm that is included in sheet music and chord progression information, for example. However, these types of information can be difficult to read and understand for beginners of a low skill level or individuals who are new to playing a musical instrument.

Therefore, various technologies for making it possible even for beginning performers or the like to easily understand information about the music and enjoy playing that music have been proposed. Patent Document 1, for example, discloses a sheet music display device in which, for playing a keyboard instrument such as an organ, chords are displayed color-coded by type in the sheet music information in order to make it easier to read information for chords to be played by the left hand without impeding reading of the sheet music for a melody to be played by the right hand.

RELATED ART DOCUMENTS

Patent Documents

Patent Document 1: Japanese Patent Application Laid-Open Publication No. 2016-224462

SUMMARY OF THE INVENTION

In a sheet music display device of the type disclosed in Patent Document 1, chord information is displayed color-coded by type in the sheet music information, which makes it possible to identify chord changes in the music being played. However, with this type of display method, it is not possible to easily discern and understand whether the type and timing of chords actually played by the user correspond to the type and timing of chords in the music to be played, and there has been demand for a way to more appropriately display the music to be played as well as information related to the user's performance status.

Therefore, the advantage of the present invention lies in making it possible to easily discern and understand the state of correspondence between the type/timing of chords in the music and in the user's performance.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a method of an electronic musical interface executed by a processor configured to communicate with a display and a musical note input device, the method comprising: receiving music data for a first segment of a musical piece from a memory, the music data containing data of a chord function progression of the first segment that is to be played by a user and data of an automatic accompaniment; causing the display to display, in a first region of the display, said chord function progression of the first segment of the musical piece that is to be played by the user by displaying identifiers specifying respective chord functions so that the user can understand what chord function to play in what order, the chord functions including tonic, dominant, or subdominant; causing the automatic accompaniment of the first segment of the music data to be played back to the user before the user starts playing the musical note input device; receiving user performance data inputted from the musical note input device as the user plays the musical note input device along with the playback of the automatic accompaniment of the first segment of the music data; analyzing each chord contained in the obtained user performance data to determine the chord function of each chord the user played; and causing the display to display, in a second region of the display alongside the first region, an identifier that identifies the determined chord function of the chord the user plays as the user plays the musical note input device, so that the user can determine whether the chord function of each chord the user played matches the chord function of the chord to be played by the user displayed in the first region.

In another aspect, the present disclosure provides a non-transitory, computer readable storage medium storing a program that causes a processor communicating with a display and a musical note input device to execute the above-described process.

In another aspect, the present disclosure provides an electronic musical interface configured to communicate with a musical note input device, comprising: a display: and a processor communicating with the display, wherein the processor perform the above-described process.

In another aspect, the present disclosure provides an electronic musical instrument, comprising: the electronic musical interface, as described above; the musical note input device; and a sound emitter that outputs musical sound in accordance with operation of the musical note input device.

It is to be understood that both the foregoing general description and the following detailed description are exemplary and explanatory, and are intended to provide further explanation of the invention as claimed.

DETAILED DESCRIPTION OF EMBODIMENTS

Next, embodiments of the present invention will be described in detail with reference to figures.

Embodiment 1

(Electronic Musical Instrument)

Figure 1:
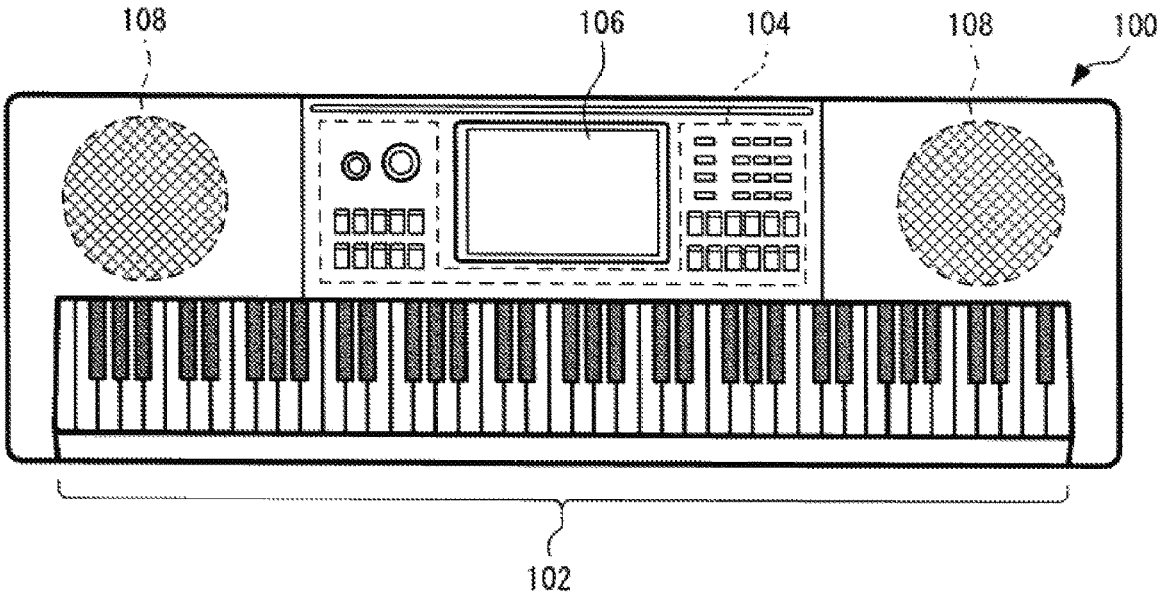
FIG. 1 is an exterior view illustrating Embodiment 1 of an electronic musical instrument including a performance information display device according to the present invention.

FIG. 1 is an exterior view illustrating Embodiment 1 of an electronic musical instrument including a performance information display device (electronic musical interface) according to an embodiment of the present invention. Here, an application in which an electronic keyboard instrument (electronic keyboard) is used as an example of an electronic musical instrument/musical note input device will be described, but various other types of electronic musical instruments such as an electronic stringed instrument (an electric guitar) may also be used as the musical note input device. Furthermore, FIG. 2 is a block diagram illustrating an example hardware configuration used in the electronic musical instrument according to the present embodiment.

As illustrated in FIG. 1, for example, the exterior of an electronic musical instrument 100 including a performance information display device according to the present invention includes, on one surface side of a main instrument unit, a keyboard 102 (musical note input device) including a plurality of keys for specifying pitches; a control panel 104 in which switches for adjusting volume, selecting tone color, and performing various other operations such as selecting features are arranged; and sound emitters 108 which emit musical sounds generated by operating the keyboard 102 or the control panel 104 and musical sounds based on internally stored music data. The electronic musical instrument 100 further includes a display panel 106 which displays sheet music information and chord information and the like based on the music data in a prescribed display format and also displays the volume, tone color, and various other settings information and the like regarding the music currently being played.

Figure 2:
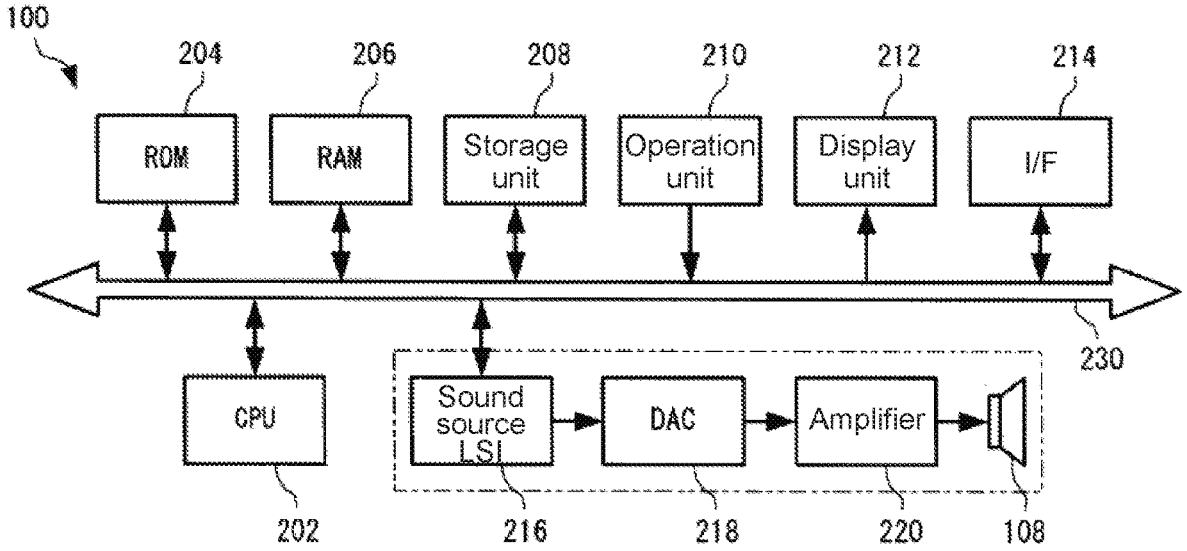
FIG. 2 is a block diagram illustrating an example hardware configuration used in the electronic musical instrument according to Embodiment 1.

As illustrated in FIG. 2, for example, the hardware configuration of the electronic musical instrument 100 includes a central processing unit (CPU) 202, a read-only memory (ROM) 204, a random-access memory (RAM) 206, a storage unit 208 such as a hard disk, an operation unit 210 including the keyboard 102 and the control panel 104, a display unit 212 including the display panel 106, and an interface (I/F) 214 which is connected to an external audio device (not illustrated in the figure) or the like, and each of these components is connected to a system bus 230. The electronic musical instrument 100 further includes a sound system including a sound source LSI 216, a digital-to-analog conversion circuit (DAC) 218, an amp 220, and sound emitters 108 such as speakers, with the sound source LSI 216 being directly connected to the system bus 230.

In the configuration described above, the CPU 202 is a main processor for controlling the operation of the components in the electronic musical instrument 100. The CPU 202 reads prescribed control programs stored in the ROM 204 and executes these programs using the RAM 206 as a data region and working region in order to perform various control operations in the electronic musical instrument 100. More particularly, in the present embodiment the CPU 202 executes a sequence of control operations including a method of displaying performance information for displaying music data stored in the storage unit 208, chord information included in performance data performed by the user, and the like in a prescribed display format on the display unit 212. The method of displaying performance information executed in the present embodiment will be described in more detail later.

The ROM 204 stores program data for control programs for various control operations to be executed by the CPU 202, waveform data and parameter data for all of the tone colors used in musical sound generation processes executed by the sound source LSI 216, and various other types of settings data. More particularly, in the present embodiment the ROM 204 stores a chord definition table for determining how chords included in music data for music played back by the electronic musical instrument 100 or chords included in performance data obtained as the user plays along with playback of the music should be categorized into the following categories (chord functions): tonic (indicating relaxation in the music), dominant (indicating strong tension), or subdominant (indicating tension). The ROM 204 also stores a display color definition table for setting display colors corresponding to the categories of the categorized chords. Note that the control programs, various types of data, and definition tables stored in the ROM 204 may be partially or completely stored in the storage unit 208 (described later) or embedded in the CPU 202 in advance.

The RAM 206 includes a data region and a working region for temporarily storing various types of data that are used or generated as the CPU 202 and the sound source LSI 216 execute prescribed control operations in accordance with the control programs stored in the ROM 204.

The storage unit 208 stores one or more sets of music data. Each set of music data is constituted by a plurality of performance segments (beats, bars, or the like) and includes pitch information, key information, chord information, and the like for the melody and accompaniment of the music. These pieces of information may be separate pieces of information stored in association with one another for each piece of music, or these pieces of information may be stored included in an integral manner into pitch information or sheet music information or the like. Moreover, the music data may be data stored in the storage unit 208 in advance during product shipment of the electronic musical instrument 100 or may be data obtained and stored in advance via the I/F 214 (described later) from an external audio device (music player or the like) or from music sites or the like on the internet when the user uses the electronic musical instrument 100. Furthermore, a portion of the storage unit 208 or the entire storage unit 208 may have a format that can be inserted into and removed from the electronic musical instrument 100 (that is, a removable format).

The operation unit 210 includes the keyboard 102 and the control panel 104 and outputs operation information to the CPU 202 when the user presses a key or operates a switch. The display unit 212 includes the display panel 106, which is a liquid crystal display (LCD) or an organic electroluminescent display (OLED) or the like that can display text, graphics, sheet music, or the like. The display unit 212 displays various types of information on the basis of input operations to the keyboard 102 or control panel 104 of the operation unit 210, processes executed internally by the electronic musical instrument 100, and the like. More particularly, in the present embodiment the display unit 212 displays sheet music information for each prescribed range of performance segments (four bars or eight bars, for example) in music to be performed and also displays display regions corresponding to the performance segments in a color-coded manner corresponding to the categories of the chords in the music being played back or the chords obtained from the user's performance. Specific examples of this will be described later.

The I/F 214 is connected to devices external to the electronic musical instrument 100 and sends and receives various types of data. More particularly, in the present embodiment the I/F 214 receives music data stored in the storage unit 208. Here, the I/F 214 may be a communication interface connected to an external audio device or communication device or to a network such as the internet via an audio cable, a data transmission cable, or various types of wireless communication technologies, for example. Moreover, the I/F 214 may be an interface that exchanges data using a storage medium such as a memory card.

The sound source LSI 216, on the basis of instructions from the CPU 202, reads pitch information obtained from music data as well as waveform data corresponding to the pitches of the keyboard 102 specified by the operation unit 210 from the ROM 204, adds prescribed audio effects, and outputs the results as musical sound waveform data. In the DAC 218, the amp 220, and the sound emitters 108, after the musical sound waveform data output from the sound source LSI 216 has been converted to an analog signal (analog musical sound waveform signal) by the DAC 218, the amp 220 amplifies that signal to a prescribed signal level, and the sound emitters 108 emit the signal as musical sounds. Note that although FIG. 2 illustrates an example in which speakers are used as the sound emitters 108, the sound emitters 108 may instead output to an audio device external to the electronic musical instrument 100 via an audio output terminal.

(Method of Controlling Electronic Musical Instrument)

Next, a method of controlling the electronic musical instrument according to the present embodiment (a method of displaying performance information) will be described with reference to figures. Here, the sequence of control processes described below is achieved by the CPU 202 of the electronic musical instrument 100 executing prescribed control programs.

Figure 3:
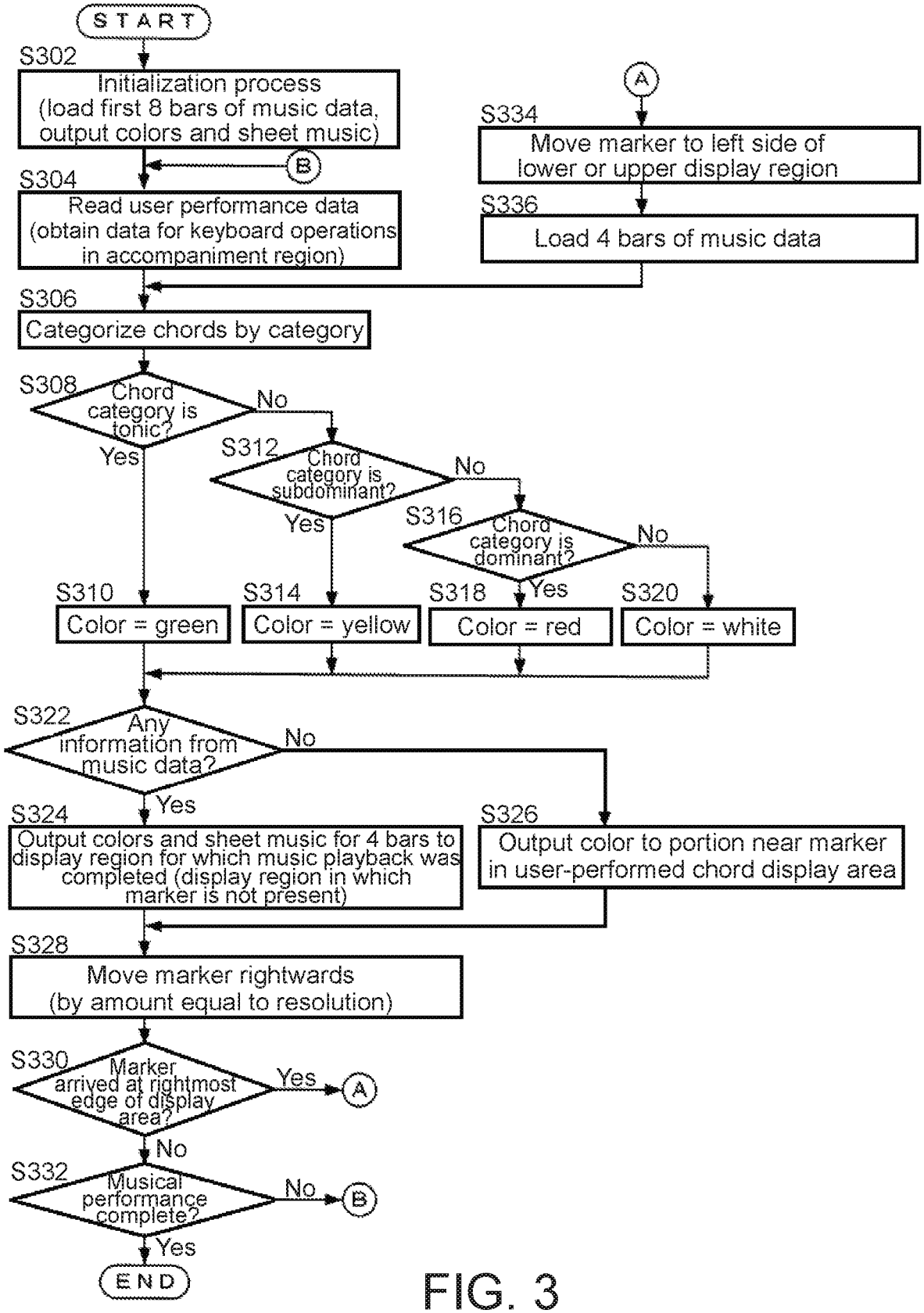
FIG. 3 is a flowchart illustrating a method of controlling the electronic musical instrument according to Embodiment 1.
Figure 4:
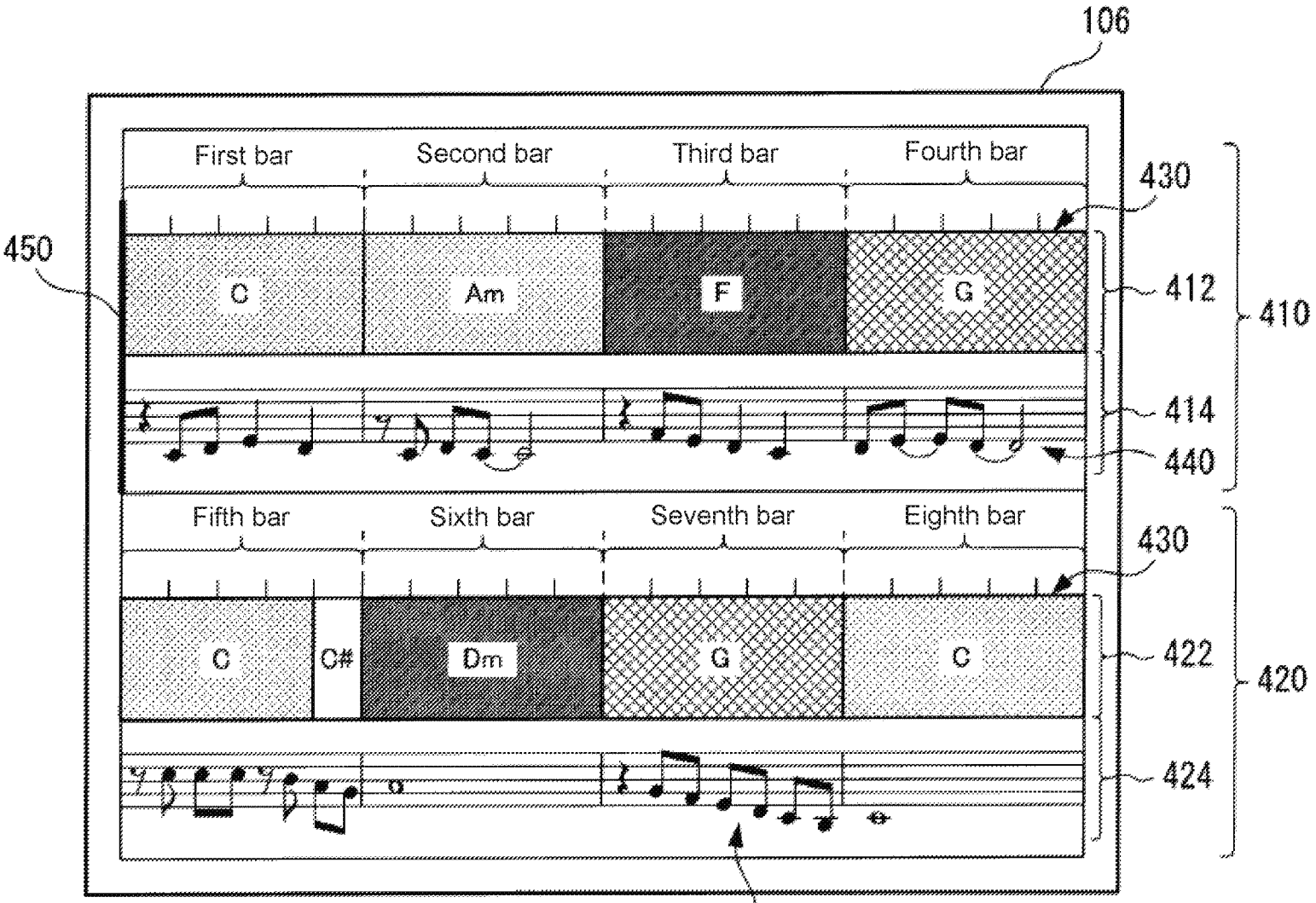
FIG. 4 illustrates a (first) example of musical information displayed using the method of controlling the electronic musical instrument according to Embodiment 1.
Figure 5:
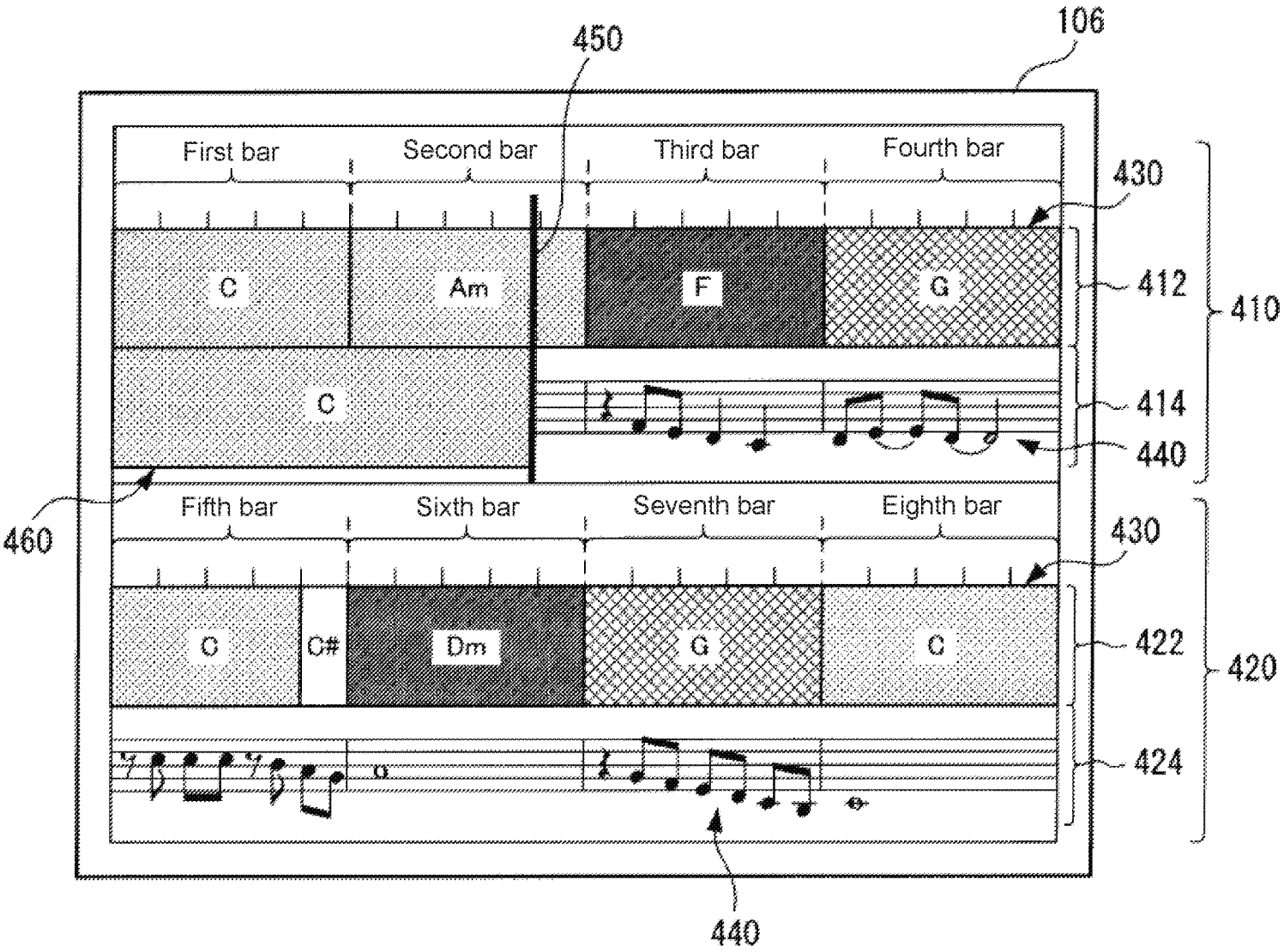
FIG. 5 illustrates a (second) example of musical information displayed using the method of controlling the electronic musical instrument according to Embodiment 1.

FIG. 3 is a flowchart illustrating a method of controlling the electronic musical instrument according to the present embodiment. FIGS. 4 and 5 illustrate examples of musical information displayed using the method of controlling the electronic musical instrument according to the present embodiment.

As illustrated in the flowchart in FIG. 3, for example, in the method of controlling the electronic musical instrument 100 according to the present embodiment (method of displaying performance information), first, the user powers on the electronic musical instrument 100 and operates the switches or the like of the control panel 104 to specify a desired piece of music, which causes the CPU 202 to execute an initialization process (step S302). In this initialization process, the CPU 202 loads data for the music specified by the user from among the music stored in the storage unit 208 and extracts musical information (pitch information, key information, chord information, sheet music information, and the like) for the initial several bars' worth (eight bars, for example) of performance segments used to play that music.

Then, the CPU 202 obtains key information and chord information from the extracted musical information and references the chord definition table stored in the ROM 204 to categorize the chords (music chords) by category (music chord categorization process). Here, the key information is information indicating whether the key is a major key or is a minor key based on the three minor scales and includes key information such as C major or A minor, for example. Moreover, the chord information is information indicating chords and includes information such as C (C major), Am (A minor), F (F major), G (G major), C# (C-sharp major), or Dm (D minor), for example.

Furthermore, the chord definition table includes definition information for categorizing chords by category as tonic, dominant, or subdominant and is defined such that when the key is C major, for example, chords such as C, CM7 (C major seventh), Am, Am7 (A minor seventh), and Em (E minor) are categorized as tonic; chords such as G and G7 (G seventh) are categorized as dominant; and chords such as F, FM7 (F major seventh), Dm, and Dm7 (D minor seventh) are categorized as subdominant. Note that in regards to the key information and chord information used when categorizing the chords by category, the information included in the musical information may be used as-is, or key information and chord information or the like may be obtained by analyzing pitch information or note-on/note-off information provided in MIDI data and then used accordingly.

Next, the CPU 202 references the display color definition table stored in the ROM 204 to, on the basis of the categories of the categorized chords, set display colors to use when displaying the chord information in the music on the display unit 212 (display color setting process). Here, the display color definition table includes definition information for identifying the categories of the categorized chords in the music with color information (a first identifier or an identifier). In this way, the table is defined such that the CPU 202 sets a green display color for chords in the tonic category, sets a red display color for dominant chords, and sets a yellow display color for subdominant chords, for example. In other words, the display colors set using the display color definition table are associated with color information that is different for each chord category.

Next, on the basis of the categories of the chords categorized in the music chord categorization process and the display colors set in the display color setting process, the CPU 202 displays chord information and sheet music information for the first eight bars of the music on the display panel 106 of the display unit 212 in a prescribed display format. More specifically, as illustrated in FIG. 4, for example, the display panel 106 is generally divided into upper and lower display regions 410 and 420, and sheet music information 440 which shows pitch information for the melody of the music in staff notation is displayed in user-performed chord display areas (second regions) 414 and 424 in lower portions of the display regions 410 and 420. Moreover, in music chord display areas (first regions) 412 and 422 in upper portions, chord information 430 for the music is displayed in the display colors (first identifier) set according to chord category so as to be aligned corresponding to the beats and bars in the staff notation for the sheet music information 440 in the lower portions (first region display process).

Here, in the user-performed chord display areas 414 and 424 of the upper and lower display regions 410 and 420 of the display panel 106, the sheet music information 440 for the musical information for eight bars of performance segments extracted from the music data are displayed divided into a first half and a second half, each being four bars long. Moreover, in the music chord display areas 412 and 422 of the upper and lower display regions 410 and 420, the chord information 430 in the musical information is displayed in the display colors (a first identifier) set according to chord category so as to correspond to the performance segments (beats and bars) in the sheet music information 440 displayed in the user-performed chord display areas 414 and 424.

In the display example illustrated in FIG. 4, in the upper display region 410 the chord information 430 and the sheet music information 440 for the first bar (first segment) to fourth bar (fourth segment) are arranged in the vertical direction with each bar aligned accordingly. Here, the C chord in the first bar and the Am chord in the second bar are categorized as tonic and therefore displayed in green, the F chord in the third bar is categorized as subdominant and therefore displayed in yellow, and the G chord in the fourth bar is categorized as dominant and therefore displayed in red.

Moreover, in the lower display region 420 the chord information 430 and the sheet music information 440 for the fifth bar (fifth segment) to eighth bar (eighth segment) are arranged in the vertical direction with each beat and bar aligned accordingly. Here, the C chords in the fifth bar and eighth bar are categorized as tonic and therefore displayed in green, the Dm chord in the sixth bar is categorized as subdominant and therefore displayed in yellow, and the G chord in the seventh bar is categorized as dominant and therefore displayed in red. Moreover, the C# chord in the fifth bar is not categorized into any of the categories among tonic, dominant, and subdominant and is therefore displayed in white (or with no color).

Furthermore, the display example illustrated in FIG. 4 corresponds to a state during the initialization process in which playback of the music or the user's performance have not yet started, and therefore a marker (current position display bar) 450 indicating the playback position of the music is displayed at the left edge of the upper display region 410 in the figure.

Next, after completing the initialization process described above, the CPU 202 plays back a piece of music specified by the user (music data playback process). As illustrated in FIGS. 4 and 5, during this music playback state, the marker 450 indicating the elapsed time and current playback position in accordance with the playback progress of the music moves rightwards in the figure on the chord information 430 and the sheet music information 440 for the music that are displayed on the display panel 106. Here, when playback of the first four bars of performance segments (first bar to fourth bar) displayed in the upper display region 410 of the display panel 106 is complete and the marker 450 arrives at the right edge of the figure, the marker 450 jumps to the left edge of the lower display region 420 in the figure and then proceeds from left to right in the figure in accordance with the playback progress of the second four bars of performance segments (fifth bar to eighth bar) displayed in that display region 420. Then, when playback of the second four bars of performance segments is complete and the marker 450 arrives at the right edge of the figure, the marker 450 jumps back up to the left edge of the upper display region 410, and then the same behavior described above is repeated until playback of the final bar in the music is complete.

The user performs the melody of the music by reading the sheet music information 440 displayed in the user-performed chord display areas 414 and 424 of the display panel 106 and performs the accompaniment (chords) of the music by reading the chord information 430 displayed in the music chord display areas (first regions) 412 and 422. Moreover, the user discerns the playback progress of the music by watching the movement of the marker 450 displayed moving along the upper and lower display regions 410 and 420 of the display panel 106. In this way, the user performs the accompaniment of the music by, in accordance with the current playback position of the music as indicated by the marker 450, reading the chord information 430 displayed at that position in the music chord display areas 412 and 422 and then specifying the corresponding chord type (Am, for example) or specifying a chord of the same chord category (C, for example).

The CPU 202 reads performance data including pitch information from the keyboard 102 that is specified by the user while performing the melody and accompaniment of the music and obtains chord information from that performance data (step S304; performance data obtaining process). The method of obtaining chord information from the performance data may be generating chord information on the basis of pitch information from the keyboard 102 that is specified in an accompaniment region further to the left than a prescribed key (a key forming a boundary between the melody and the accompaniment) among those of the keyboard 102 in which a plurality of (88) keys are arranged, or may be generating chord information by monitoring all of the pitch information from the keyboard 102 that is specified while performing the melody and accompaniment and extracting the pitch information corresponding to chords, for example.

Next, on the basis of the chord information obtained by the performance data obtaining process and the key information for the music being played back, the CPU 202 references the chord definition table stored in the ROM 204 to categorize the chords (performed chords) by category (step S306; performance data categorization process). Then, the CPU 202 determines whether the categories of the categorized chords are tonic, subdominant, or dominant (steps S308, S312, and S316) and references the display color definition table stored in the ROM 204 to set the display colors for when displaying the chord information during the user's performance on the display unit 212 (display color setting process). Here, on the basis of the definition information in the display color definition table used when setting the display colors for the chord information in the music during the initialization process described above, the CPU 202 sets color information (a second identifier or an identifier, which is the same identifier as the first identifier in terms of color coding) for identifying the categories of the chords in the performance data of the user. In this way, when the category of a chord specified in the user's performance is tonic (Yes in step S308), the CPU 202 sets a green display color (step S310); when the category of a chord is subdominant (No in step S308 and Yes in step S312), the CPU 202 sets a yellow display color (step S314);

and when the category of a chord is dominant (No in step S312 and Yes in step S316), the CPU 202 sets a red display color (step S318), for example. Moreover, when the category of a chord is not categorized as any of tonic, dominant, or subdominant (No in step S316), the CPU 202 sets a white (or colorless) display color (step S320).

Next, the CPU 202 determines whether any new musical information has been obtained from the music data (step S322). In other words, as playback of the music progresses, when playback of the first four bars or second four bars of performance segments displayed in the upper or lower display regions 410 or 420 of the display panel 106 is complete, the CPU 202 determines whether any musical information (chord information and sheet music information) for subsequent performance segments to be displayed in that display regions 410 or 420 has been extracted from the music data loaded from the storage unit 208.

If there is new musical information from the music data (Yes in step S322), the CPU 202 displays the chord information and sheet music information for the next four bars of performance segments as obtained from the musical information in the display region 410 or 420 for which music playback was complete (step S324).

Meanwhile, if there is no new musical information from the music data (No in step S322), the CPU 202, on the basis of the categories of the chords categorized in steps S306 to S320 as described above and on the basis of the display colors set according to those chord categories, displays the chord information specified in the user's performance on the display panel 106 of the display unit 212 in a prescribed display format. More specifically, as illustrated in FIG. 5, for example, in the user-performed chord display area 414 (second region) in the lower portion of the display region 410 for which the music is currently being played back and in which the marker 450 is displayed moving along among the display regions 410 and 420 of the display panel 106, chord information 460 specified in the user's performance is displayed in a display color set according to chord category so as to overwrite and replace a region of the sheet music information 440 that was in past (the region on the left side of the marker 450 in the figure), with the position of the marker 450 serving as a boundary (step S326; second region display process). Here, display of the chord information 460 in the user-performed chord display area 414 is performed according to the units of data size (that is, the resolution or granularity) used when reading the performance data including the pitch information from the keyboard 102 that is specified in the user's performance, for example. After displaying this chord information 460, the CPU 202 moves the marker 450 rightwards in the figure by an amount equal to the resolution corresponding to the abovementioned units of data size (step S328).

In the display example illustrated in FIG. 5, the playback progress of the music is displayed by the marker 450, which has moved to a position in the latter half of the second bar (second segment). Here, while the chord information 430 for the music is a C chord (first identifier) in the first bar and an Am chord (first identifier) in the second bar, as shown in the music chord display area 412, the chord information 460 specified in the user's performance is a C chord (second identifier) in both the first bar (first segment) and the second bar (second segment), as shown in the region of the user-performed chord display area 414 on the left side of the marker 450 in the figure. In other words, the user's performance included specifying a chord that was different from the chord information 430 for the music. However, in the music chord categorization process of the present embodiment, the C chord and the Am chord are both categorized as tonic, and therefore the C chord in the first bar and the Am chord in the second bar of the music chord display area 412 as well as the C chord in the region of the user-performed chord display area 414 on the left side of the marker 450 in the figure (from the first bar to the latter half of the second bar) are all displayed in the same display color (the first identifier and the second identifier are both green). Here, it is well-known that performing a different type of chord generally does not result in a significant change to the music or musical feel as long as that chord has the same category.

More specifically, a first identifier (in the example in FIG. 5, the green color indicating that the Am chord is tonic) for identifying whether a chord for a first segment (in the example in FIG. 5, the second bar) from a first timing to before a second timing that is included in music data stored in a memory prior to when a user begins performing has any of a tonic, dominant, or subdominant chord function is displayed in a first region (412) of a display;

the first segment of the music data (in the example in FIG. 5, the second bar) is played;

user performance data is obtained as the user performs along with playback of the first segment of the music data (in the example in FIG. 5, the second bar);

a chord in the obtained user performance data is categorized as having any of the tonic, dominant, or subdominant chord functions (in the example in FIG. 5, the C chord is tonic); and a second identifier (in the example in FIG. 5, the green color indicating tonic) for identifying the categorized chord function is displayed in a second region (414) of the display that corresponds to the first region (412).

Next, the CPU 202 determines whether the marker 450 that moves rightwards in the figure in accordance with the playback progress of the music in the upper and lower display regions 410 and 420 of the display panel 106 has arrived at the right edge of those display regions 410 or 420 in the figure (step S330). If the marker 450 has arrived at the right edge of the upper or lower display region 410 or 420 in the figure and playback of the four bars of performance segments displayed in that display region 410 or 420 (in FIG. 5, the first bar to fourth bar in the display region 410) is complete (Yes in step S330), the CPU 202 moves the marker 450 to the left edge (in the figure) of the lower or upper display region 420 or 410 (in FIG. 5, the display region 420) in which the chord information and sheet music information for the next four bars of performance segments (in FIG. 5, the fifth bar to eighth bar) are displayed (step S334). Next, the CPU 202 loads the music data to be displayed in the display region 410 or 420 (in FIG. 5, the display region 410) for which playback of the performance segments was completed and extracts the musical information (chord information, key information, sheet music information, and the like) for the next four bars of performance segments (the ninth bar to twelfth bar) (step S336). Then, the CPU 202 returns to previously described step S306, categorizes the chords by category based on the extracted musical information, and proceeds to repeat the sequence of processes from step S308 to S330 as described above.

Meanwhile, if the marker 450 has not arrived at the right edge of the display region 410 or 420 in the figure and playback of the performance segments displayed in that display region 410 or 420 is still ongoing (No in step S330), the CPU 202 determines whether playback of all of the performance segments in the music has been completed or whether the user's performance is complete (step S332). If playback of all of the performance segments in the music is not yet complete or the user's performance is not yet complete (No in step S332), the CPU 202 returns to previously described step S304, continues reading performance data specified in the user's performance, obtains chord information, and then proceeds to repeat the sequence of processes from step S306 to S332 as described above. Meanwhile, if playback of all of the performance segments in the music is complete or the user's performance is complete (Yes in step S332), the CPU 202 ends this sequence of the method of controlling the electronic musical instrument 100 (method of displaying performance information).

Note that in steps S322 to S326 of the method of controlling the electronic musical instrument (method of displaying performance information) described above, the process of determining whether any musical information (chord information and sheet music information) has been obtained from the music data and displaying the musical information for the next performance segments on the display panel 106 (step S324) as well as the process of displaying the chord information specified in the user's performance in a color-coded manner near the marker on the display panel 106 (step S326) were described as being performed selectively. However, the present invention is not limited to this approach, and the process of displaying the musical information for the next performance segments on the display panel 106 (step S324) as well as the process of displaying the chord information specified in the user's performance in a color-coded manner on the display panel 106 (step S326) may be performed in parallel.

As described above, in the present embodiment, by viewing the display colors in the music chord display areas 412 and 422 displayed on the display panel 106, the user can recognize chord information 430 for specific performance segments (the fourth to eighth bars, for example) in the past and future relative to the current playback position of the music, and by viewing the display colors in the user-performed chord display areas 414 and 424, the user can recognize current and past chord information 460 specified in the user's performance. Furthermore, the music chord display areas 412 and 422 and the user-performed chord display areas 414 and 424 are respectively arranged vertically so as to correspond to the bars and beats of the music, which allows the user to, both while and after performing, compare the chord types and categories as well as the timing of changes therein in the music with those of the user's own performance and thereby easily determine and understand the state of correspondence therebetween (whether these items match).

Moreover, in the present embodiment, sheet music information for specific performance segments of the music is displayed in the user-performed chord display areas 414 and 424 while the current playback position of the music is indicated by the marker 450, which allows the user to, while being aware of the current playback progress of the music, easily understand the chord types and categories as well as the timing of changes therein and thereby perform accordingly.

In addition, in the present embodiment, the idea that each chord has a theoretical category (or function) and that the progression of chords (chord type and the timing of changes therein) in the music playback or performance is built on the basis of chord category can be intuitively understood visually regardless of knowledge of music theory.

Furthermore, as described above, performing a different type of chord generally does not result in a significant change to the music or musical feel as long as that chord has the same category, and therefore in the present embodiment, by disabling emission of chords during music playback and, while looking only at the chord information 430 for the music as displayed on the display panel 106, performing by specifying chords that match the chord progression of the music, the user can gain experience with musical arrangements in which different chords are assigned to the music, for example.

Modification Example

Next, a modification example of the embodiment described above will be described.

Figure 6:
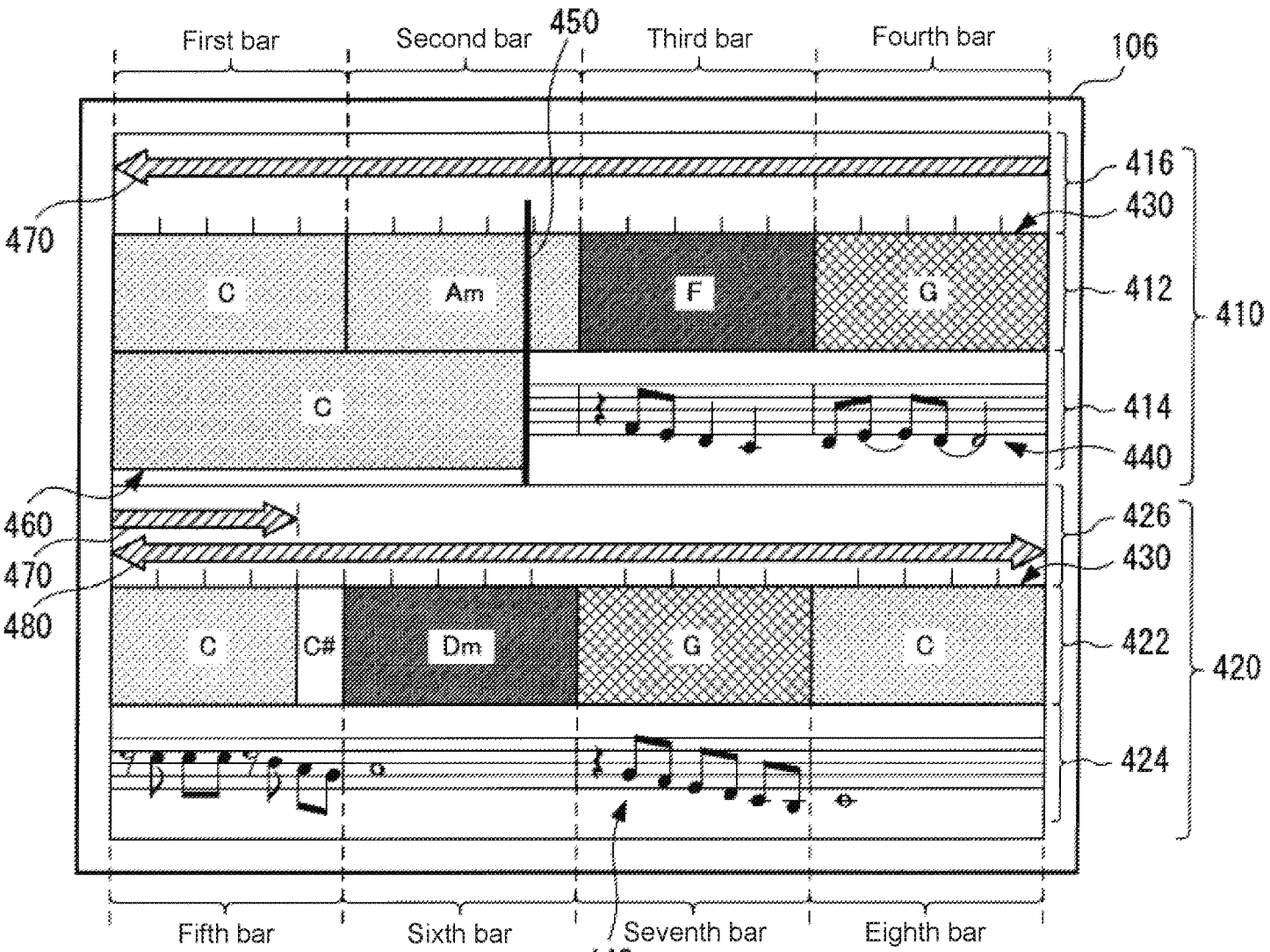
FIG. 6 illustrates another example of musical information displayed using the method of controlling the electronic musical instrument according to Embodiment 1.

FIG. 6 illustrates another example of musical information displayed using the method of controlling the electronic musical instrument according to the present embodiment. Here, display contents that are the same as in the embodiment described above will not be described again.

In the embodiment described above, a method of displaying performance information in which chord information for the music and chord information specified in the user's performance are displayed for each performance segment in the display regions 410 and 420 of the display panel 106 of the electronic musical instrument 100 using color information for identifying the categories of the chords was described. The present modification example includes a method of displaying performance information in which, in addition to the display format described in the embodiment above, information (symbols for identifying performance segments such as arrows, color information, or the like) for identifying cadences (groups of chord progressions which define the progression of the music) is displayed on the basis of chord changes in the music.

In the present modification example, in addition to the features described in the embodiment above, the CPU 202 sequentially stores the categories of the chords categorized on the basis of the musical information (key information and chord information) extracted from the music data in the RAM 206 or the like, determines whether a group of chord progressions constitutes a cadence each time the chord category changes, and, upon determining that a cadence is present, executes a control operation of displaying color information or arrow symbols or the like (a third identifier) for identifying the type or range of the cadence in the display regions 410 and 420 of the display panel 106.

Here, in regards to whether a chord progression constitutes a cadence as well as the type of that cadence, chord progression patterns representing a plurality of types of cadences are stored in the ROM 204 in advance, for example, and these patterns are referenced each time the category of the categorized chords changes in order to determine whether a cadence is present and to determine the type of that cadence. Moreover, definition information for identifying the types of the identified cadences with color information is stored in the ROM 204 in advance, and display colors are set according to cadence type. In addition, information about cadences may be included in the music data in advance as musical information.

More specifically, as illustrated in FIG. 6, for example, in the display regions 410 and 420 of the display panel 106, similar to in the embodiment described above, music chord display areas 412 and 422 in which chord information 430 for the music is displayed in display colors corresponding to chord category as well as user-performed chord display areas 414 and 424 in which sheet music information 440 for the music is displayed are arranged aligned in the vertical direction. Moreover, the display regions 410 and 420 respectively include cadence display areas (third regions) 416 and 426, in which cadence information including the cadence type and chord progression range as determined on the basis of changes in the categories of the categorized chords in the music is displayed, in display colors set according to cadence type, using double-headed arrow symbols indicating the range of the group of chord progressions forming the cadence (third region display process).

Here, an example of a group of chord progressions that forms a cadence is one in which the chord category starts from tonic and then changes to subdominant and dominant before ending on another tonic. In the display example in FIG. 6, an arrow symbol 470 defining a range lasting from the first bar to the latter half of the fifth bar is displayed in the cadence display areas 416 and 426 of the upper and lower display regions 410 and 420 of the display panel 106. Moreover, an arrow symbol 480 defining a range lasting from the latter half of the fifth bar to the ninth bar is displayed in the cadence display area 426 of the lower display region 420.

The arrow symbol 470 indicates a cadence that includes the group of chord progressions for a range including the C chord in the first bar and the Am chord in the second bar of the music which are categorized into the tonic chord category, the F chord in the third bar which is categorized as subdominant, the G chord in the fourth bar which is categorized as dominant, and the C chord in the fifth bar which is categorized as tonic. Moreover, the arrow symbol 480 indicates a cadence that includes the group of chord progressions for a range including the C chord in the fifth bar which is categorized into the tonic chord category, the C# chord in the fifth bar which is not categorized into any category, the Dm chord in the sixth bar which is categorized as subdominant, the G chord in the seventh bar which is categorized as dominant, and the C chord in the eighth bar which is categorized as tonic. The display colors set for the arrow symbols 470 and 480 indicating these cadences are associated with color information that is different for each type of cadence. Furthermore, the display example (FIG. 6) of the present modification example depicts a case in which the cadences have the same type, so the display colors set for the arrow symbols 470 and 480 are associated with the same color information.

In this way, in the present modification example, by comparing the display colors in the music chord display areas 412 and 422 and in the user-performed chord display areas 414 and 424 displayed on the display panel 106, the user and easily discern and understand the state of correspondence between the type, category, and timing of changes in the chords in the music and in the user's own performance, and by viewing the arrow symbols 470 and 480 and the display colors thereof in the cadence display areas 416 and 426, the user can intuitively understand the construction and connections of cadences in the music (that is, the progression of the music) visually as well as perform while being aware of these cadences.

Note that although this modification example and the embodiment above describe a configuration in which, as illustrated in FIGS. 4 to 6, sheet music information for the music as well as cadence information are displayed on the display panel 106 in addition to the chord information for the music and the chord information specified in the user's performance, the present invention is not limited to these examples, and the user may be allowed to freely enable and disable display of the additional sheet music information or cadence information while the chord information for the music and the chord information specified in the user's performance remain the primary required display elements.

Embodiment 2

Next, Embodiment 2 of an electronic musical instrument including a performance information display device according to the present invention will be described.

Figure 7:
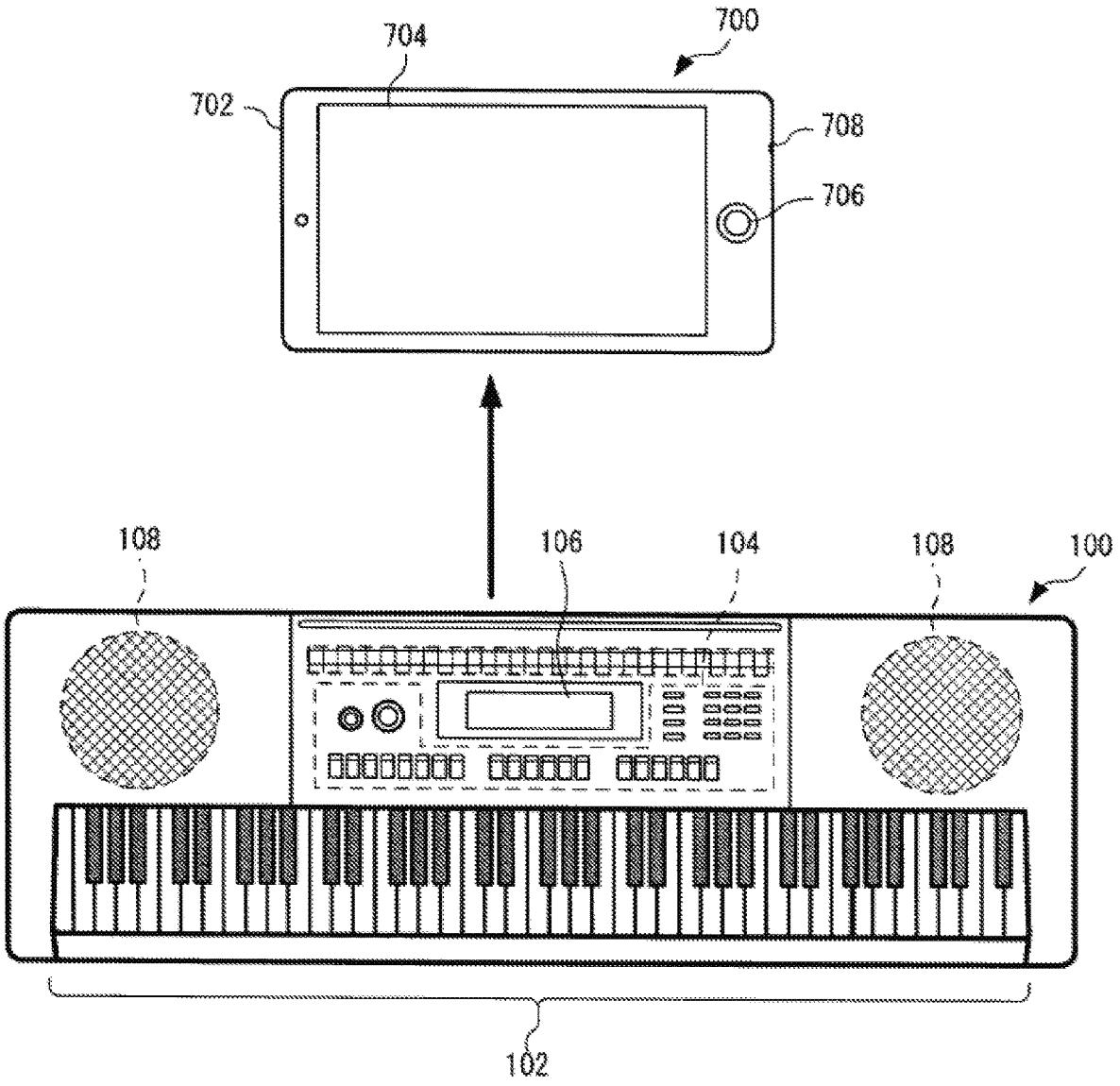
FIG. 7 is an exterior view illustrating Embodiment 2 of an electronic musical instrument including a performance information display device according to the present invention.
Figure 8:
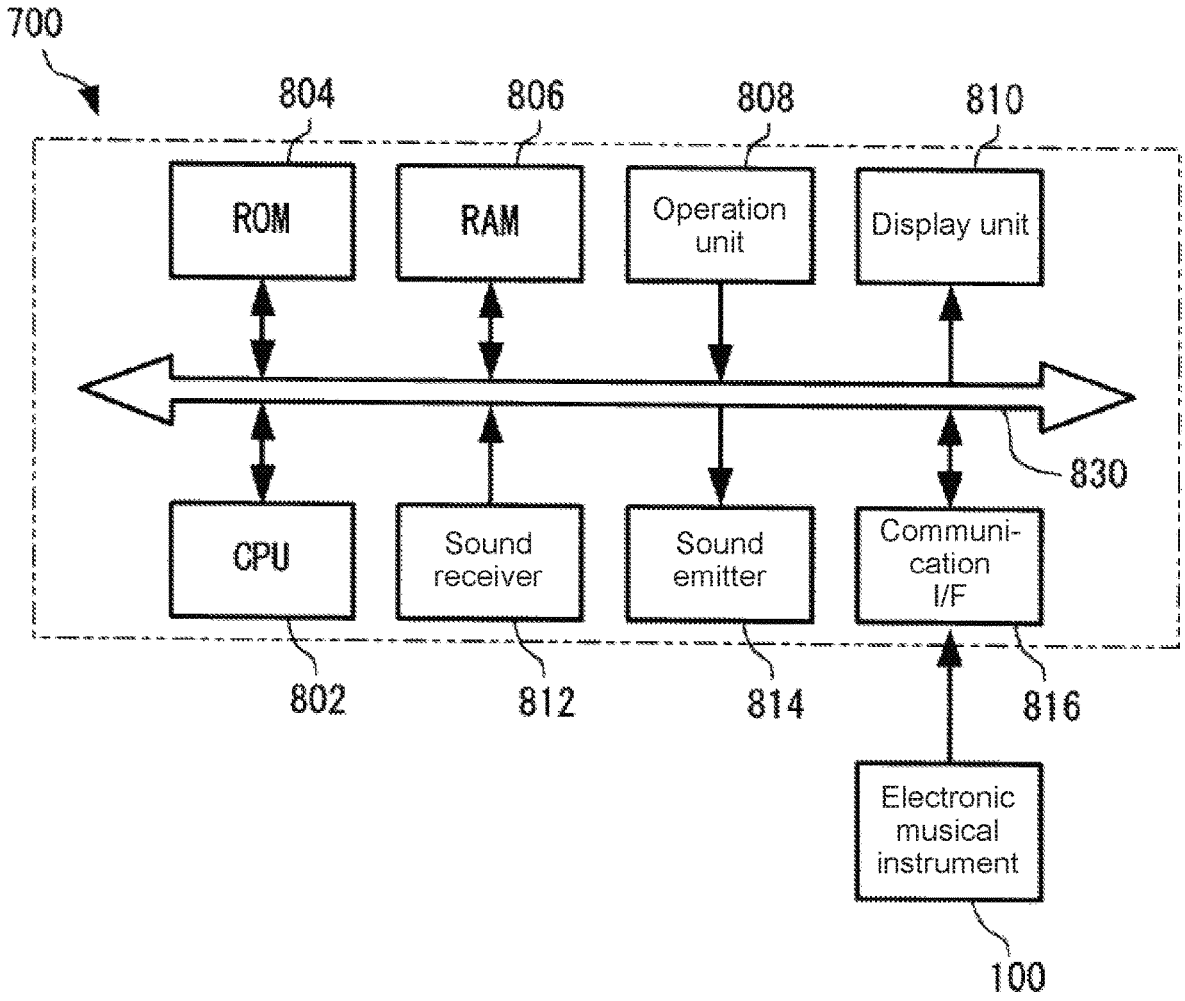
FIG. 8 is a block diagram illustrating an example hardware configuration used in an information device according to Embodiment 2.

FIG. 7 is an exterior view illustrating Embodiment 2 of the electronic musical instrument including the performance information display device according to the present invention. FIG. 8 is a block diagram illustrating an example hardware configuration used in an information device according to the present embodiment. Here, components that are the same as in Embodiment 1 above will not be described again.

Embodiment 1 above describes a configuration in which the performance information display device according to the present invention is built into an electronic musical instrument; that is, a configuration in which the performance information display device and the electronic musical instrument are integrated together. Embodiment 2 has a configuration in which the performance information display device and the electronic musical instrument are separate.

As illustrated in FIG. 7, for example, the present embodiment includes an electronic musical instrument 100 such as an electronic keyboard instrument and an information device 700 such as a smartphone, tablet computer, or personal computer. The electronic musical instrument 100 has substantially the same hardware configuration as the electronic musical instrument 100 described above in Embodiment 1 (see FIG. 2), but has a configuration that does not include the features for implementing the method of displaying performance information according to the present invention. In other words, the electronic musical instrument 100 includes at least a feature for generating and emitting musical sounds on the basis of the user's performance or internally stored music data as well as a feature for sending the internally stored music data or performance data including pitch information specified in the user's performance to the external information device 700.

The information device 700 has features for implementing the method of displaying performance information described above in Embodiment 1. As illustrated in FIGS. 7 and 8, for example, the information device 700 includes a CPU 802 and RAM 806 for executing a method of displaying performance information in which music data and chord information or the like included in the performance data performed by the user that are sent from the electronic musical instrument 100 are displayed on a display unit 810 in a prescribed display format; a ROM 804 which stores control programs, a chord definition table, and a display color definition table for executing the method of displaying performance information; and an operation unit 808 which includes an operation button 706 arranged on the front surface or side face of a device case 702 as well as a touch panel, mouse, keyboard, or the like formed integrally with a display panel 704 of the display unit 810. The information device 700 further includes a sound receiver 812 including a microphone 708 or the like which captures sound information from the external environment, a sound emitter 814 which outputs internally generated musical sounds or the like, and a communication I/F 816 which receives performance data and music data sent from the external electronic musical instrument 100. The components described above are respectively connected to a system bus 830.

Here, in the communication I/F 816, the approach used to receive the performance data and music data sent from the electronic musical instrument 100 may be using a wired scheme via an audio cable or various types of data transmission cables or may be using various types of wireless schemes such as Bluetooth (registered trademark) or Wi-Fi (registered trademark), for example.

In the configuration described above, on the basis of the performance data and music data sent from the electronic musical instrument 100, the information device 700 displays, on the display panel 704 of the display unit 810, and in the display format illustrated in FIGS. 4 to 6, for example, chord information for the music and chord information specified in the user's performance for each performance segment using color information for identifying the categories of the chords. Moreover, a marker which indicates the current playback position is displayed moving in accordance with the playback progress of the music.

Here, by placing the information device 700 on a music stand or music rest of the electronic keyboard instrument used for the electronic musical instrument 100, for example, the performance information displayed on the display panel 704 can be viewed more satisfactorily by the user. Moreover, in the information device 700, control programs for implementing the same method of displaying performance information as in Embodiment 1 may be embedded in the ROM 804 or CPU 802 of the information device 700 in advance or may be provided and installed as application programs (applications).

In this way, in the present embodiment, even when the electronic musical instrument 100 does not include features for implementing the method of displaying performance information according to the present invention, features or components of the information device 700 such as a general-purpose smartphone, tablet computer, or personal computer can be used to display chord information for the music and chord information specified in the user's performance on the display panel 704 in display colors defined according to the categories of those chords. Thus, regardless of the make or model of the electronic musical instrument 100, the user can use a readily available information device 700 to compare the chord types and categories as well as the timing of changes therein in the music with those of the user's own performance and thereby easily determine and understand the state of correspondence therebetween (whether these items match).

Note that although the present embodiment describes a case in which music data and performance data sent from the external electronic musical instrument 100 are received via the communication I/F 816 using a wired scheme or a wireless scheme, the present invention is not limited to this example, and musical sounds generated during the user's performance and emitted from speakers or the like of the sound emitter 108 of the electronic musical instrument 100 may be captured by the microphone 708 of the sound receiver 812 of the information device 700 and then displayed using display colors defined in advance by categorizing the chords into categories, for example. In this configuration, the musical instrument which emits musical sounds is not limited to being an electronic musical instrument and may be an acoustic musical instrument such as a grand piano or an acoustic guitar, for example.

Moreover, although in the embodiments above the user was described as performing using an electronic musical instrument, the present invention is not limited to these examples, and by installing an application on the information device 700 such as a smartphone, tablet computer, or personal computer, the information device 700 can be used as an electronic musical instrument such as an electronic keyboard instrument and be equipped features for implementing the method of displaying performance information according to the present invention, for example.

Moreover, although in the embodiments above the marker 450 indicating the playback position of the music was described as being displayed moving along in a relative manner to the chord information and sheet music information for the music that are displayed on the display panel 106 of the electronic musical instrument 100 or on the display panel 704 of the information device 700, the present invention is not limited to these examples, and the display position of the marker 450 indicating the playback position of the music may be fixed while the chord information and sheet music information for the music are displayed moving along in a relative manner.

Although several embodiments of the present invention were described above, the present invention is not limited to these embodiments and includes the invention as defined in the claims as well as configurations of equivalent scope.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A method of an electronic musical interface executed by a processor configured to communicate with a display and a musical note input device, the method comprising:

receiving music data for a first segment of a musical piece from a memory, the music data containing data of a chord function progression of the first segment that is to be played by a user and data of an automatic accompaniment;

causing the display to display, in a first region of the display, said chord function progression of the first segment of the musical piece that is to be played by the user by displaying identifiers specifying respective chord functions so that the user can understand what chord function to play in what order, the chord functions including tonic, dominant, or subdominant;

causing the automatic accompaniment of the first segment of the music data to be played back to the user before the user starts playing the musical note input device;

receiving user performance data inputted from the musical note input device as the user plays the musical note input device along with the playback of the automatic accompaniment of the first segment of the music data;

analyzing each chord contained in the obtained user performance data to determine the chord function of each chord the user played; and causing the display to display, in a second region of the display alongside the first region, an identifier that identifies the determined chord function of the chord the user plays as the user plays the musical note input device, so that the user can determine whether the chord function of each chord the user played matches the chord function of the chord to be played by the user displayed in the first region.

2. The method according to claim 1, wherein the identifiers are colored areas that identify the chord functions by color, and wherein mutually different color is respectively associated with the tonic, dominant, and subdominant.

3. The method according to claim 1, wherein the first region and the second region are arranged aligned in a vertical direction on the display.

4. The method according to claim 1, further comprising causing a marker that is moved within the display in accordance with playback of the music to be displayed in the display, the marker indicating a current playback position of the music.

5. The method according to claim 1, wherein sheet music information to be performed by the user is initially displayed in the second region of the display before the user plays the musical note input device, and wherein as the user plays the musical note input device, the sheet music information is being replaced successively by the identifiers.

6. The method according to claim 1, further comprising causing another identifier that identifies a group of chord progressions in the music data to be displayed in a third region of the display.

7. The method according to claim 1, wherein the music data contains data of a melody part to be played by the user in addition to said data of the chord function progression of the first segment that is to be played by the user and said data of the automatic accompaniment, and said data of the chord function progression of the first segment that is to be played by the user corresponds to a chord function progression of the automatic accompaniment.

8. A non-transitory, computer readable storage medium storing a program that causes a processor communicating with a display and a musical note input device to execute the following:

receiving music data for a first segment of a musical piece from a memory, the music data containing data of a chord function progression of the first segment that is to be played by a user and data of an automatic accompaniment;

causing the display to display, in a first region of the display, said chord function progression of the first segment of the musical piece that is to be played by the user by displaying identifiers specifying respective chord functions so that the user can understand what chord function to play in what order, the chord functions including tonic, dominant, or subdominant;

causing the automatic accompaniment of the first segment of the music data to be played back to the user before the user starts playing the musical note input device;

receiving user performance data inputted from the musical note input device as the user plays the musical note input device along with the playback of the automatic accompaniment of the first segment of the music data;

analyzing each chord contained in the obtained user performance data to determine the chord function of each chord the user played; and causing the display to display, in a second region of the display alongside the first region, an identifier that identifies the determined chord function of the chord the user plays as the user plays the musical note input device, so that the user can determine whether the chord function of each chord the user played matches the chord function of the chord to be played by the user displayed in the first region.

9. The non-transitory, computer readable storage medium according to claim 8, wherein the music data contains data of a melody part to be played by the user in addition to said data of the chord function progression of the first segment that is to be played by the user and said data of the automatic accompaniment, and said data of the chord function progression of the first segment that is to be played by the user corresponds to a chord function progression of the automatic accompaniment.

10. An electronic musical interface configured to communicate with a musical note input device, comprising:

a display: and a processor communicating with the display, wherein the processor performs the following:

receiving music data for a first segment of a musical piece from a memory, the music data containing data of a chord function progression of the first segment that is to be played by a user and data of an automatic accompaniment;

causing the display to display, in a first region of the display, said chord function progression of the first segment of the musical piece that is to be played by the user by displaying identifiers specifying respective chord functions so that the user can understand what chord function to play in what order, the chord functions including tonic, dominant, or subdominant;

causing the automatic accompaniment of the first segment of the music data to be played back to the user before the user starts playing the musical note input device;

receiving user performance data inputted from the musical note input device as the user plays the musical note input device along with the playback of the automatic accompaniment of the first segment of the music data;

analyzing each chord contained in the obtained user performance data to determine the chord function of each chord the user played; and causing the display to display, in a second region of the display alongside the first region, an identifier that identifies the determined chord function of the chord the user plays as the user plays the musical note input device, so that the user can determine whether the chord function of each chord the user played matches the chord function of the chord to be played by the user displayed in the first region.

11. The electronic musical interface according to claim 10, wherein the identifiers are colored areas that identify the chord functions by color, and wherein mutually different color is respectively associated with the tonic, dominant, and subdominant.

12. The electronic musical interface according to claim 10, wherein the first region and the second region are arranged aligned in a vertical direction on the display.

13. The electronic musical interface according to claim 10, wherein the processor further causes a marker that is moved within the display in accordance with playback of the music to be displayed in the display, the marker indicating a current playback position of the music.

14. The electronic musical interface according to claim 10, wherein sheet music information to be performed by the user is initially displayed in the second region of the display before the user plays the musical note input device, and wherein as the user plays the musical note input device, the sheet music information is being replaced successively by the identifiers.

15. The electronic musical interface according to claim 10, wherein the processor further causes another identifier that identifies a group of chord progressions in the music data to be displayed in a third region of the display.

16. An electronic musical instrument, comprising:

the electronic musical interface as set forth in claim 10;

said musical note input device; and a sound emitter that outputs musical sound in accordance with operation of the musical note input device.

17. The electronic musical interface according to claim 10, wherein the music data contains data of a melody part to be played by the user in addition to said data of the chord function progression of the first segment that is to be played by the user and said data of the automatic accompaniment, and said data of the chord function progression of the first segment that is to be played by the user corresponds to a chord function progression of the automatic accompaniment.

* * * * *